United States Patent [19]

Hashiba et al.

[11] Patent Number: 4,780,641

[45] Date of Patent: Oct. 25, 1988

[54] COLOR SELECTIVE ELECTRODE OF CATHODE RAY TUBE

[75] Inventors: Atsushi Hashiba; Takahide Sanma, both of Aichi, Japan

[73] Assignee: Sony Corporation, Tokyo, Japan

[21] Appl. No.: 852,660

[22] Filed: Apr. 16, 1986

[30] Foreign Application Priority Data

Apr. 17, 1985 [JP] Japan ..... 60-82084

[51] Int. Cl.[4] ..... H01J 29/02

[52] U.S. Cl. ..... 313/269; 313/404; 313/407

[58] Field of Search ..... 313/402, 403, 407, 269, 313/404; 445/37, 30

[56] References Cited

U.S. PATENT DOCUMENTS 3,638,063 1/1972 Tachikawa et al. ..... 313/269

*Primary Examiner*—David K. Moore

*Assistant Examiner*—Michael Horabik

*Attorney, Agent, or Firm*—Hill, Van Santen, Steadman & Simpson

[57] ABSTRACT

In a color selective electrode of a cathode ray tube, a number of grid elements are stretched between a pair of arms of a frame, a damper wire is stretched on the grid elements by means of spring elements fixed to a pair of support members of the frame, and each spring element is provided with a locking means for temporarily positioning the damper wire, whereby the damper wire is fixed temporarily to the locking means during the forming of the fluorescent surface on the tube, and restored to a spaced, final position after forming the fluorescent surface.

4 Claims, 4 Drawing Sheets

COLOR SELECTIVE ELECTRODE OF CATHODE RAY TUBE

BACKGROUND OF THE INVENTION

1. Field of the Invention

The present invention relates to a color selective electrode of a cathode ray tube, and more particularly to an aperture grill for such a tube.

In a color selective electrode, for example, an aperture grill of a cathode ray tube of the invention, where a damper wire is stretched on grid elements by means of spring elements secured on both support members of the color selective electrode, each spring element is provided with a locking member which can temporarily fix the damper wire by shifting it from a prescribed position, so that during the forming of a fluorescent surface, the damper wire is temporarily fixed to the locking member while a carbon stripe, a fluorescent stripe or the like is formed, and after forming the fluorescent surface the damper wire is restored to the prescribed non-locked position, whereby deterioration of the picture quality due to so-called damper shadow, can be suppressed.

2. Description of the Prior Art

As shown in FIG. 1, in a cathode ray tube of, for example, Trinitron (registered Trademark) configuration, an aperture grill 1 is used as color selective electrode. The aperture grill 1 comprises a frame 13 composed of a pair of arms 2 and a pair of support members 5, and a number of linear grid elements 3 stretched between the arms 2 at prescribed pitches. A damper wire 4 is stretched on the surface of the grid elements 3 of the aperture grill 1 so that the grid elements 3 are prevented from deviation and deterioration of the color quality due to resonance by external vibration is minimized. The damper wire 4 is a thin wire made of tungsten or the like and attached to spring elements 6 by a thin strip 7 of stainless steel by means of seam welding. The support ends of elements 6 are similarly fixed to the support members 5 of the aperture grill 1 by welding.

As above described, in the cathode ray tube using the aperture grill 1 with the damper wire 4 stretched thereon, deterioration of the picture quality based on so-called damper shadow may occur. Damper shadow is produced in the following manner. In the process of forming a fluorescent surface as shown in FIG. 6A, when exposure is performed with ultraviolet ray 7 and carbon stripes and fluorescent stripes 8 are formed, a, shadow region 9 due to the damper wire 4 produces a defect portion or thinned portion 10 in the carbon stripes or the fluorescent stripes 8. After completing the fluorescent surface, when an image is reproduced with an electron beam 11 as shown in FIG. 6B, the thinned portion 10 is overlaid with the shadow region 9 produced by the damper wire 4 interrupting the electron beam so that the fluorescent stripes 8 in the thinned portion 10 are not lit. Consequently, the damper shadow is produced.

This problem of damper shadow becomes significant as the cathode ray tube becomes of high precision. In order to solve the problem of damper shadow, a method of attaching a damper wire 4 as shown in FIG. 7 has been proposed. In this method, the damper wire 4 is attached to a certain position of a grid element 3 and a fluorescent surface is formed as shown in FIG. 7A. Next, the damper wire 4 is shifted a suitable distance from the original position whefeby the position of the damper wire 4 at the final state is determined as shown :n FIG. 7b. In this arrangement, the problem of damper shadow caused by the double factors, (the shadow 9 of the damper wire 4 during forming the fluoresent surface and the shadow 9 of the damper wire 4 during the image reproduction,) as in the prior art (refer to FIGS. 1, 6A and 6B), is reduced to one-half.

In order to change the attaching position of the damper wire 4 before forming the fluorescent surface and after forming it, in the prior art, the spring material 6 and the damper wire 4 are attached individually to different respective positions. Although the problem of damper shadow can be reduced in this construction, excessive labor for the temporary fixing is required and the troublesome work to change the attaching positions is required.

SUMMARY OF THE INVENTION

An object of the invention is to provide a color selective electrode of a cathode ray tube wherein the above-mentioned problem can be solved.

In a color selective electrode of a cathode ray tube according to the invention, wherein a number of grid elements 3 are stretched between a pair of arms 2 of a frame 13 and a damper wire 4 is stretched on the grid elements 3 by means of spring element 21 fixed to a pair of support members 5 of the frame 13, each spring element 21 is provided with a locking, or positioning, means for temporarily fixing the damper wire 4, so that the damper wire 4 is fixed to the locking means during forming the fluorescent surface and restored to the prescribed, spaced, position after forming the fluorescent surface.

The locking means may be any means which can lock the damper wire 4 temporarily to the spring element 21 and permit it to move easily to the prescribed position without automatic shifting. For example, the spring 21 may be provided with a recess 22 of suitable depth or a projection 23 of suitable height, either providing an edge abutment where the damper wire 4 is to be locked.

According to a color selective electrode of a cathode ray tube of the invention, positions of a damper wire can be changed before forming a fluorescent surface and after forming, it by a locking means for temporary locking installed on spring elements, and the moving can be easily performed without necessitating any excessive member.

PREFERRED EMBODIMENTS OF THE INVENTION

An embodiment of the invention together with manufacturing process of a cathode ray tube will now be described referring to FIGS. 2 through 5.

Figure 1:
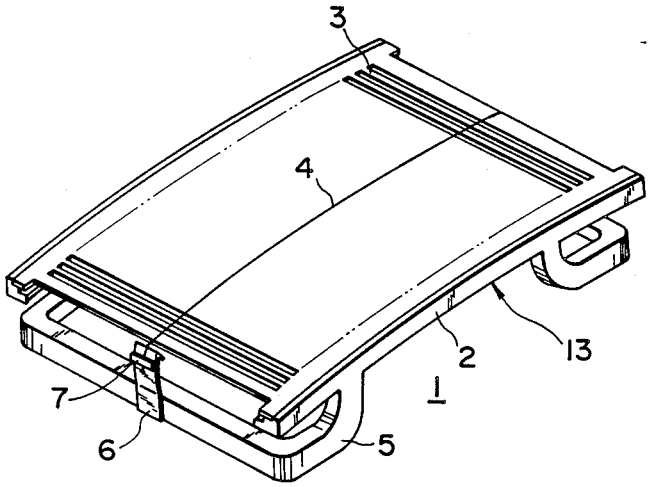
FIG. 1 (PRIOR ART)
FIG. 1 is a perspective view illustrating a damper wire attached to an aperture grill in the prior art.
Figure 2:
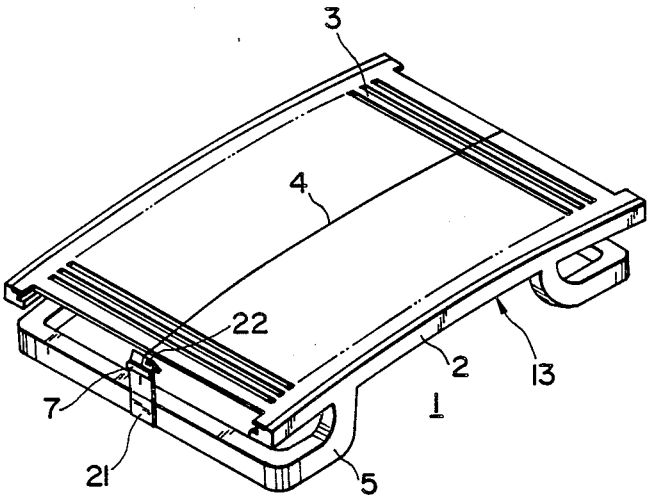
FIG. 2 is a perspective view of an aperture grill of the invention.

FIG. 2 shows an aperture grill 1 of the invention. In FIG. 2, a number of grid elements 3 are stretched between a pair of arms 2 of a frame 13, and spring elements 21 each having a locking means as hereinafter described are fixed to a pair of support members 5 of the frames 13, and further a damper wire 4 is stretched between the springs 21.

Figure 3:
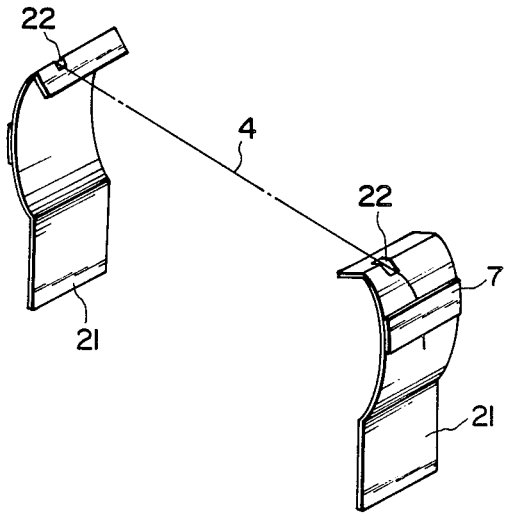
FIGS. 3 and 4 are perspective views of spring materials of the invention illustrating moving states of a damper wire.
Figure 4:
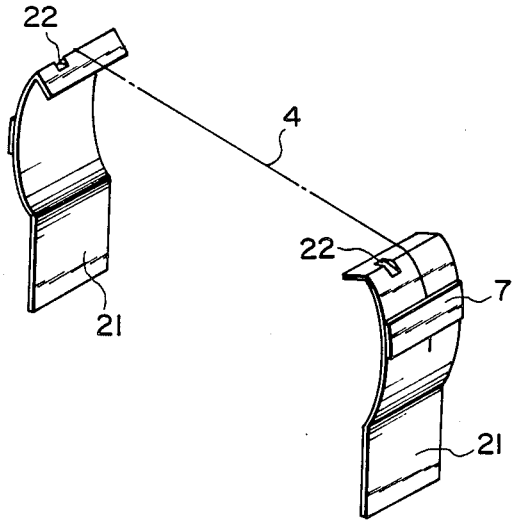

Each spring 21 of the invention has a recess 22 as locking, or positioning, means formed on its free end at a position spaced from a prescribed position where the damper wire 4 is to be locked finally (a spacing distance larger than 100 times diameter of damper wire 4 is appropriate). Depth of the recess may be specified so that the damper wire is not accidentally moved due to vibration during forming a fluorescent surface and can be easily restored to the prescribed position after forming the fluorescent surface. The pair of spring elements 21 are arranged laterally and held at a prescribed spacing (lateral distance from the grid element) and subjected to seam welding of the damper wire 4 through a thin band 7 of stainless steel, and then fixed respectively to the support members 5 of the frame 13, by means of spot welding for example, whereby the damper wire 4 is stretched under tension by, and between, the springs 21. During the process of forming a fluorescent surface of carbon stripes, fluorescent stripes or the like, on the glass 12, the damper wire 4 is temporarily positioned in the recess 22 as shown in FIG. 3. After finishing formation of the fluorescent surface, the damper wire 4 is released from the temporary position in the recess 22 and restored to the prescribed position shown in FIG. 2 and 4. Subsequently, the cathode ray tube is completed through an ordinary manufacturing process.

As above described, according to the invention, since positions of the damper wire 4 are changed between the times of forming the fluorescent surface and tube completion, the problem of so-called damper shadow based on the shadow 9 of the damper wire 4 during forming the fluorescent surface and the shadow 9 of the damper wire 4 during scanning of the electron beam in use can be reduced. Since the moving of the damper wire 4 can be easily performed without necessitating any separate member, the manufacturing efficiency can be improved.

Figure 5:
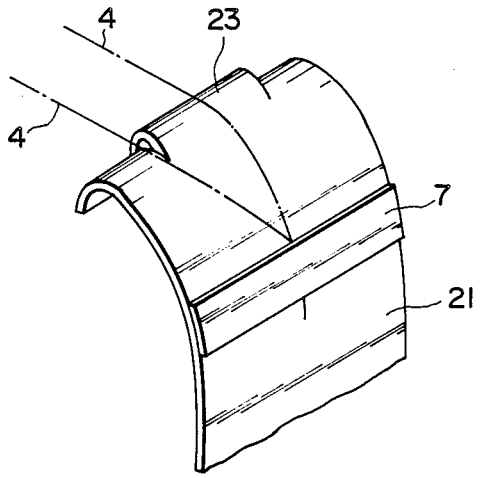
FIG. 5 is a perspective view of a spring material as another embodiment.
Figure 6A:
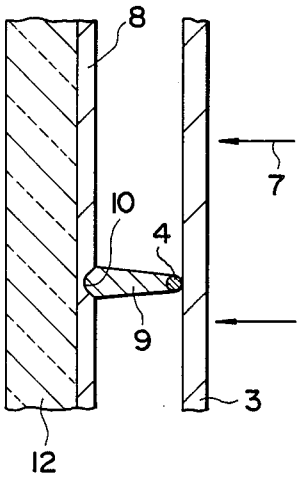
FIGS. 6A, 6B and 7A, 7B are sectional views illustrating attaching states of a damper wire in the prior
Figure 6B:
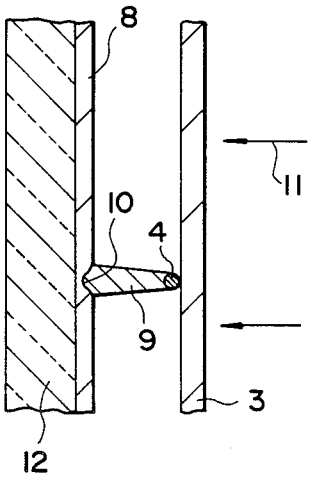
Figure 7A:
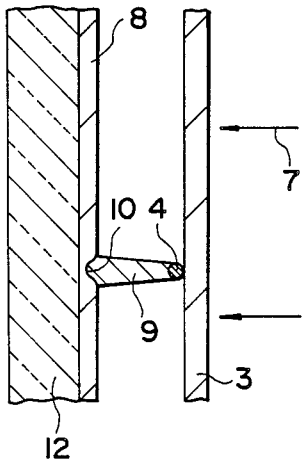
Figure 7B:
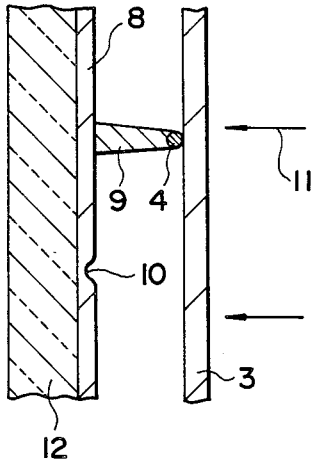

FIG. 5 shows a modified spring member 21 as another embodiment of the invention. The spring material 21 is provided with a locking or positioning means by forming a projection 23 having a length twice as large as the distance from the position where the damper wire 4 is finally stretched to the position where it is temporarily fixed. In the case of this spring 21, the damper wire 4 is locked to the end, or edge, surface of the projection 23 whereby the temporary fixing is performed. The forming of such a projection 23 is advantageous in that the same spring element 21 can then be used at both sides and accordingly true identical springs 21 can be used. Of course, if desired, each spring element 21 shown in FIGS. 2 and 3 could be provided with a pair of spaced notches 22, thereby allowing use of a single stamping configuration.

According to the invention, since positions of the damper wire are changed before forming the fluorescent surface and after forming it, even if the diameter of the damper wire is not decreasd, the problem of so-called damper shadow as in the prior art can be reduced. Consequently, deterioration of the tube's picture quality can be prevented even where the cathode ray tube is of high precision. Moreover, according to the invention, the number of members and processes required for moving the damper wire may be decreased in comparison to the prior art.

We claim as our invention:

1. In a color selective electrode of a cathode ray tube having a plurality of grid elements stretched between a pair of arms of a frame, and a damper wire stretched on the grid elements by means of positioning said damper wire at a prescribed final position on one end of each of a pair of spring elements which elements are fixed at their other ends to respective support members of the frame at opposite sides of said grid elements, characterized in that each spring element is provided with a positive wire positioning means spaced from said prescribed final position for temporarily fixing the damper wire relative to the spring element at a point spaced from the prescribed final position, so that the damper wire is fixed temporarily during forming a fluorescent surface and restored to said prescribed final position after forming the fluorescent surface.

2. The strucuture of claim 1 wherein said positive positioning means comprises an abutment on the spring element at the said one end thereof at a point spaced from its final prescribed position.

3. The structure of claim 2 wherein said positive wire positioning means comprises a notch and said abutment comprises a side wall of the notch.

4. The structure of claim 2 wherein each spring element has a pair of said abutments substantially equally spaced on opposite sides of said final position.

* * * * *